United States Patent [19]

Barrett

[11] Patent Number: 4,712,303

[45] Date of Patent: Dec. 15, 1987

[54] STRAIGHT KNIFE MACHINE WITH SAFETY FEATURES

[75] Inventor: Robert C. Barrett, Angola, N.Y.

[73] Assignee: Eastman Machine Company, Buffalo, N.Y.

[21] Appl. No.: 700,721

[22] Filed: Feb. 11, 1985

[51] Int. Cl.[4] ..... B26B 7/00

[52] U.S. Cl. ..... 30/275; 307/328; 361/179

[58] Field of Search ..... 30/273, 275, 274; 310/50; 307/119, 326, 328; 361/179; 83/544, 545, 546, DIG. 1

[56] References Cited

U.S. PATENT DOCUMENTS 1,253,134 1/1918 Breining ..... 30/275

FOREIGN PATENT DOCUMENTS 0057782 8/1982 European Pat. Off. .
855681 11/1952 Fed. Rep. of Germany .
25830 8/1963 Fed. Rep. of Germany .
88924 4/1972 Fed. Rep. of Germany .
2619789 11/1977 Fed. Rep. of Germany ..... 30/275

*Primary Examiner*—Douglas D. Watts
*Attorney, Agent, or Firm*—Christel, Bean & Linihan

[57] ABSTRACT

A cutting machine comprising a housing having a base, a motor carried by the housing, a knife blade having a cutting edge and carried by the housing for reciprocal motion generally normal to the base in response to operation of the motor, a presser foot movably carried by the housing located in spaced relation to the blade cutting edge and movable toward and away from the base, and characterized by an elongated guard connected to the presser foot and located closely adjacent the blade edge and guided supported in the housing for movement along the blade edge in response to movement of the presser foot toward and away from the base. There is included an arrangement for releasing the presser foot when the motor is turned off allowing the pressure foot to rest on or near the base and maintain the guard in place along the blade edge when the motor is off. The machine includes a sharpening mechanism movably carried by the housing for travel in opposite directions along the blade when it is to be sharpened, and the guard is flexeible to accommodate the presence of the sharpenng mechanism. In response to movement of the presser foot, the flexible guard moves along a first path closely adjacent the blade edge, a second path offset from the first path and defined in the machine housing and a third path joining the first and second paths and extending about along the sharpening mechanism. During movement of the sharpening mechanism along the blade, the flexible guard is guided away from the blade by a guide carried by the sharpener mechanism and is returned close to the blade edge as the sharpener returns to its rest position.

25 Claims, 38 Drawing Figures

Fig. 1.
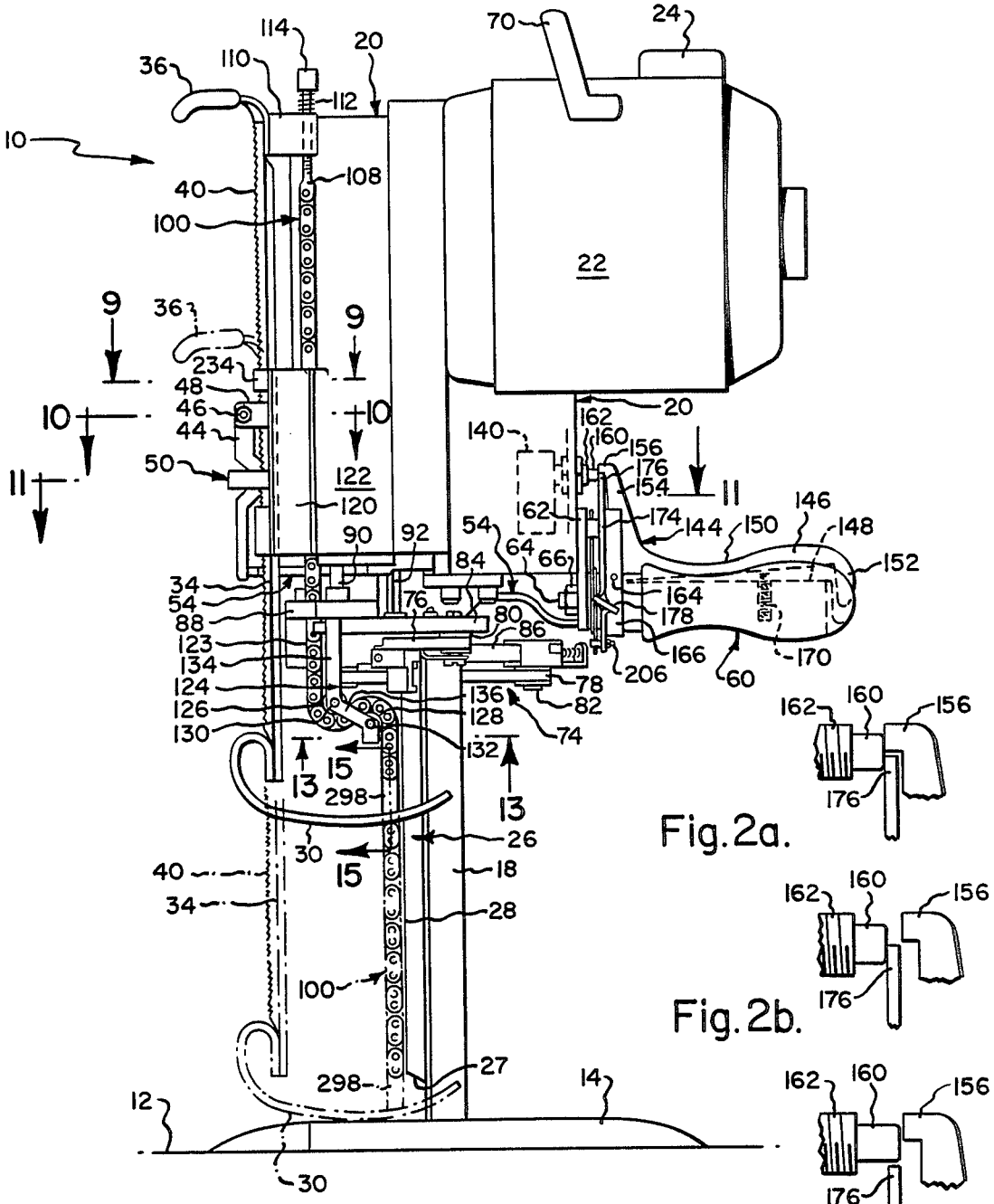
Fig. 2a.
Fig. 2b.
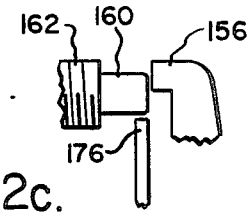
Fig. 2c.
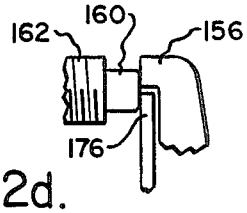
Fig. 2d.

Fig. 6.
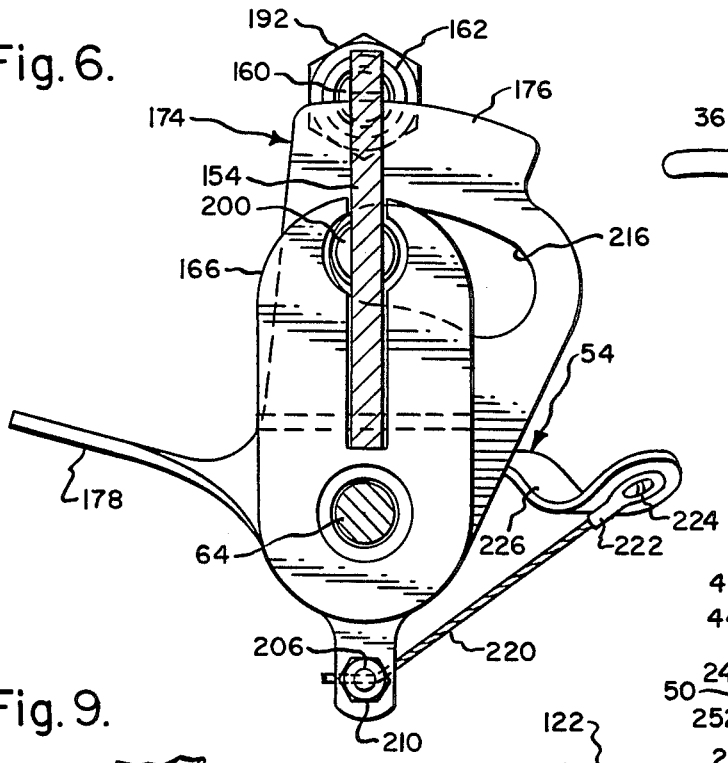
Fig. 8.
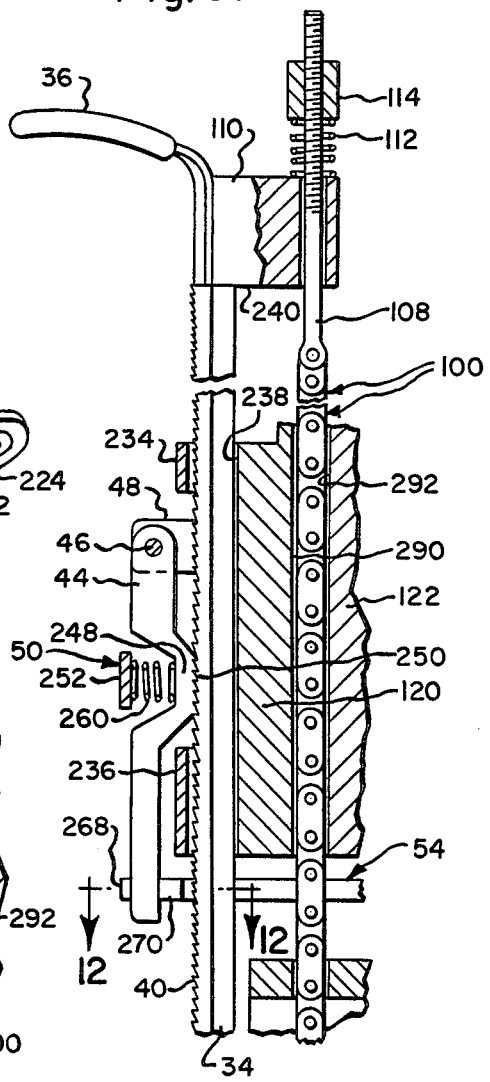
Fig. 9.
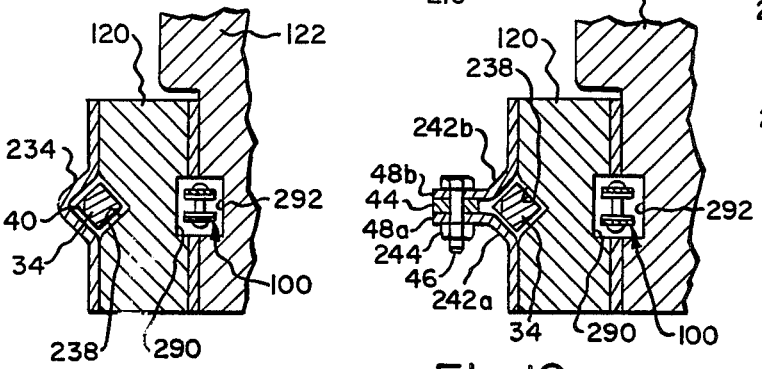
Fig. 10.
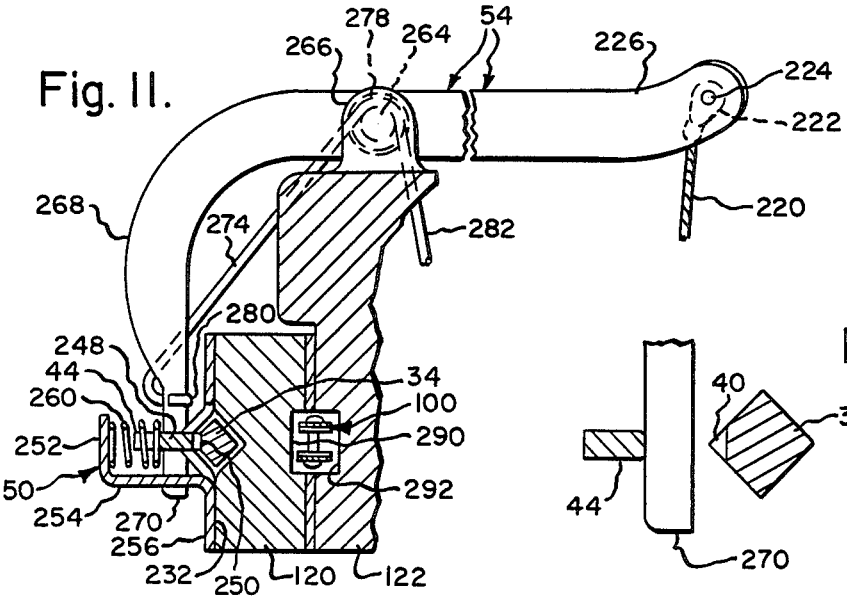
Fig. 11.
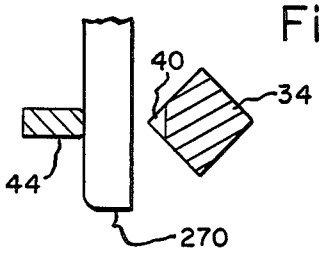
Fig. 12.

Fig. 13.
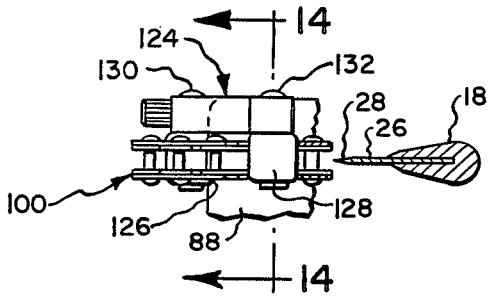
Fig. 14.
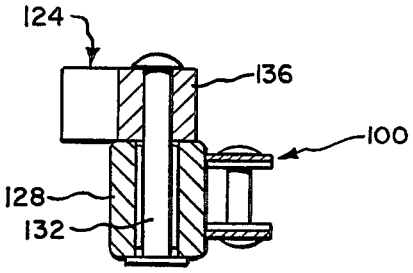
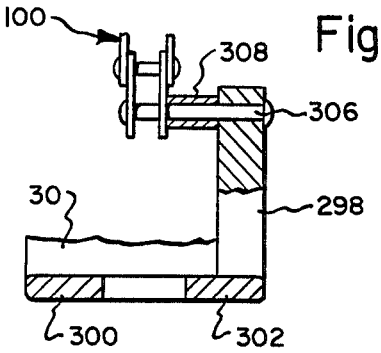
Fig. 15.
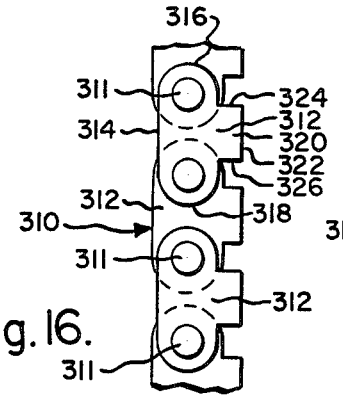
Fig. 16.
Fig. 17.
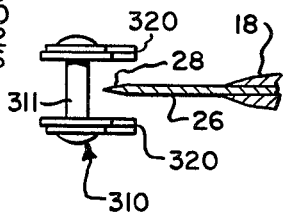
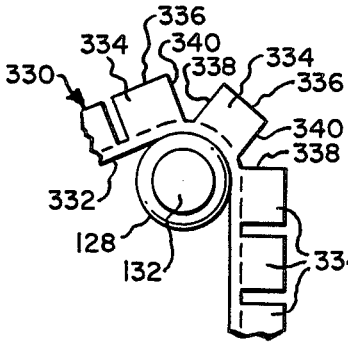
Fig. 18.
Fig. 19.
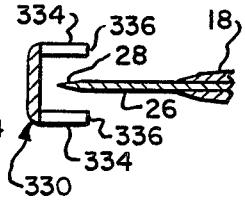
Fig. 32.
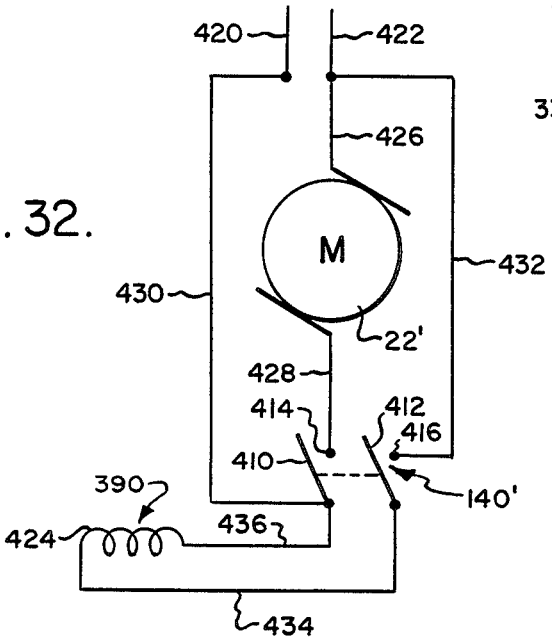

STRAIGHT KNIFE MACHINE WITH SAFETY FEATURES

BACKGROUND OF THE INVENTION

This invention relates to the art of cutting machines for cloth and other sheet materials in which cutting is effected by a reciprocating knife, and more particularly to new and improved safety measures for such machines.

One area of use of the present invention is in straight knife machines moved and guided manually over and along a surface supporting a stack or pile of sheets to be cut and wherein the knife is reciprocated generally normal to that surface, although the principles of the present invention can be variously applied. The blade of such machines is extremely sharp and can pose a safety hazard, particularly when the machine is idle and if the edge of the blade is left exposed. Such machines often include a sharpener assembly carried by the housing adjacent the upper end of the blade and moved down and back along the blade during sharpening. Thus, the presence and operation of such a sharpener poses a problem in providing a guard close to the blade edge.

It would, therefore, be highly desirable to provide such a machine wherein the blade is inaccessible to persons, both when the machine is operating and when it is stopped. It would be particularly advantageous to provide a safety means or guard close to the blade edge and which automatically goes into place when the machine is stopped. Also, it would be desirable to provide such a machine which does not start simply when the handle is gripped but which requires some additional voluntary action by the person using the machine.

SUMMARY OF THE INVENTION

It is, therefore, a primary object of this invention to provide a new and improved straight knife machine with various safety features.

It is a further object of this invention to provide such a machine having a guard which when in place is close to the knife blade edge.

It is a further object of this invention to provide such a machine having a guard for the knife blade edge which automatically goes into place when the machine is stopped.

It is a further object of this invention to provide such a machine which requires more than one manipulative operation to place the machine in operation.

It is a further object of this invention to provide such a machine wherein the knife blade is relatively inaccessible to persons, both when the machine is operating and when it is stopped.

It is a further object of this invention to provide such a machine having safety features to accomplish the foregoing and which is relatively simple in construction and efficient and effective in operation.

The present invention provides a cutting machine comprising a housing having a base, a motor carried by the housing, a knife blade having a cutting edge and carried by the housing for reciprocal motion generally normal to the base in response to operation of the motor, presser foot means movably carried by the housing located in spaced relation to the blade cutting edge and movable toward and away from the base, and characterized by elongated guard means operatively connected to the presser foot means and located closely adjacent the blade edge and guided supported in the housing form movement along the blade edge in response to movement of the presser foot means toward and away from the base. The machine includes a manually operated arrangement for turning the motor on and automatically turning it off, functioning like a deadman switch. There is provided means operatively connected to this arrangement and to a mechanism associated with the presser foot means for releasing the presser foot means when the motor is turned off allowing the presser foot means to rest on or near the base and maintain the guard in place along the blade edge when the motor is off. The machine includes a sharpening mechanism movably carried by the housing for travel in opposite directions along the blade when it is to be sharpened, and the guard means is flexible to accommodate the presence of the sharpening mechanism. In response to movement of the presser foot means, the flexible guard means moves along a first path closely adjacent the blade edge, a second path offset from the first path and defined in the machine housing and a third path joining the first and second paths and extending about along the sharpening mechanism. During movement of the sharpening mechanism along the blade, the flexible guard means is guided away from the blade by guide means carried by the sharpener mechanism and is returned close to the blade edge as the sharpener returns to its rest position.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a side elevational view of a straight knife machine having safety measures according to the present invention;

FIGS. *2a–2d* are fragmentary elevational views illustrating various stages of operation of the switch and operator members in the machine of FIG. 1;

FIG. 6 is a fragmentary elevational view, partly in section, taken about on line 6—6 in FIG. 3;

FIG. 8 is an enlarged fragmentary elevational view, partly in section, illustrating in further detail the arrangement of the presser foot shaft, arm, lever and related components in the machine of FIG. 1;

FIG. 9 is a fragmentary sectional view taken about on line 9—9 in FIG. 1;

FIG. 10 is a fragmentary sectional view taken about on line 10—10 in FIG. 1;

FIG. 11 is a fragmentary elevational view, partly in section, taken about on line 11—11 in FIG. 1;

FIG. 12 is a fragmentary sectional view taken about on line 12—12 in FIG. 8;

FIG. 13 is a fragmentary elevational view taken about on line 13—13 in FIG. 1;

FIG. 14 is a sectional view taken about on line 14—14 in FIG. 13;

FIG. 15 is a fragmentary sectional view taken about on line 15—15 in FIG. 1;

FIG. 16 is a fragmentary elevational view showing one alternative form of guard for use in the machine of FIG. 1;

FIG. 17 is a fragmentary plan view, partly in section, illustrating the relationship of the guard of FIG. 16 to the machine knife blade edge;

FIG. 18 is a fragmentary elevational view of another alternative form of guard for use in the machine of FIG. 1;

FIG. 19 is a fragmentary plan view, partly in section, illustrating the relationship between the guard of FIG. 18 and the machine knife blade edge;

Figure 20:
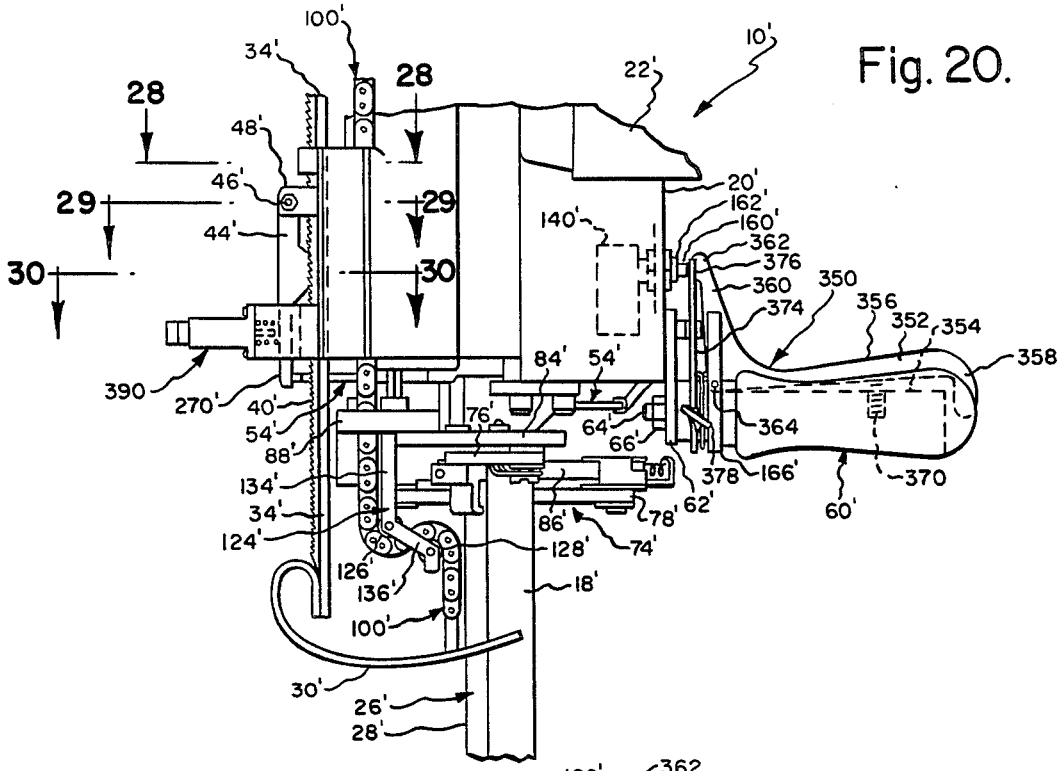
FIG. 20 is a fragmentary side elevational view of a machine similar to that of FIG. 1 provided with safety features according to another embodiment of the present invention.
Figure 22:
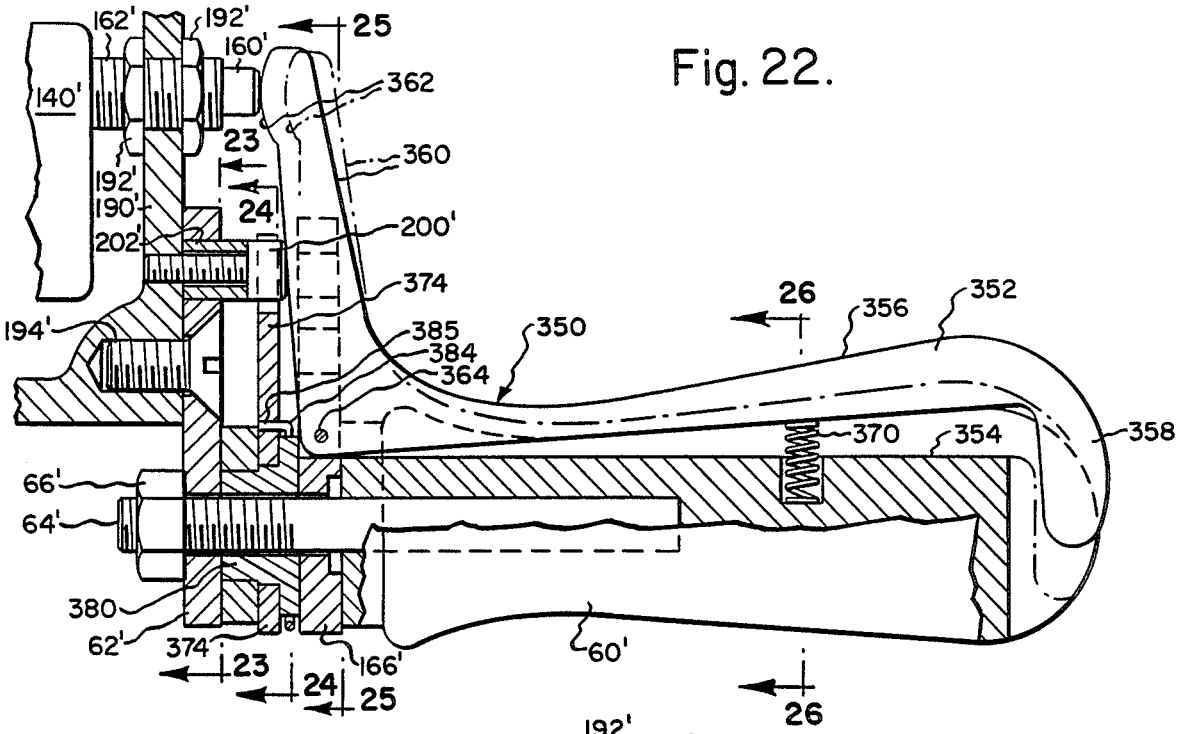
Figure 23:
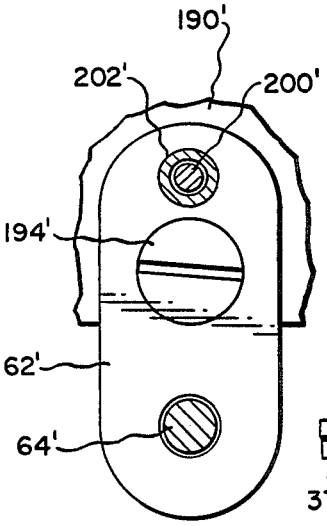
Figure 24:
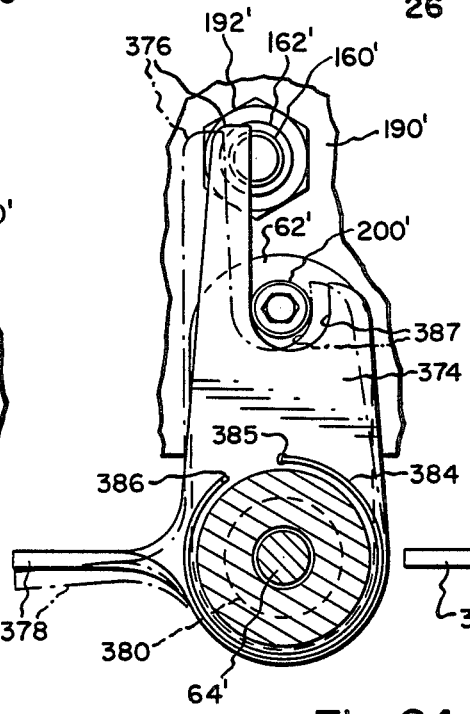
Figure 25:
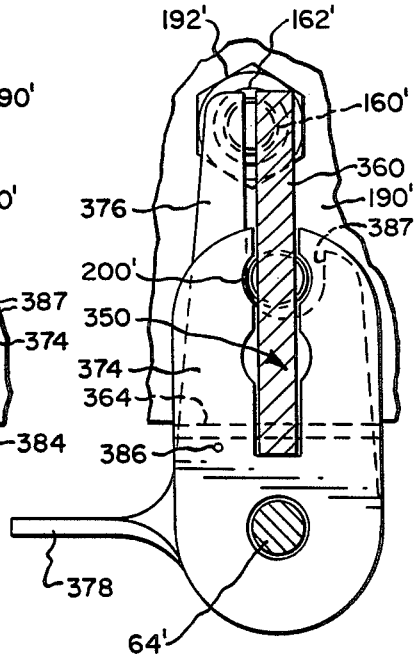
Figure 26:
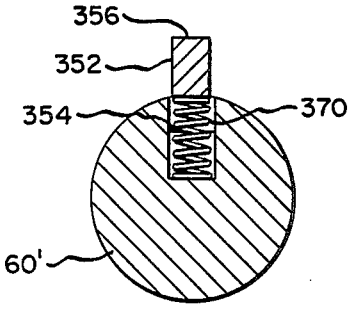
Figure 27:
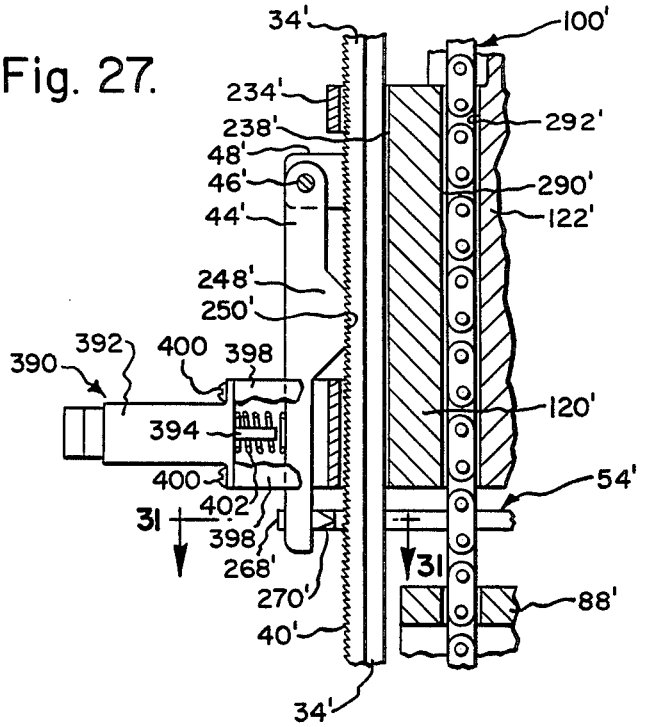
Figure 28:
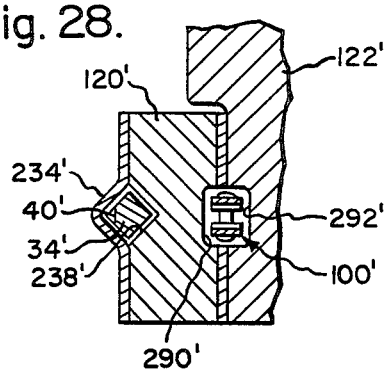
Figure 29:
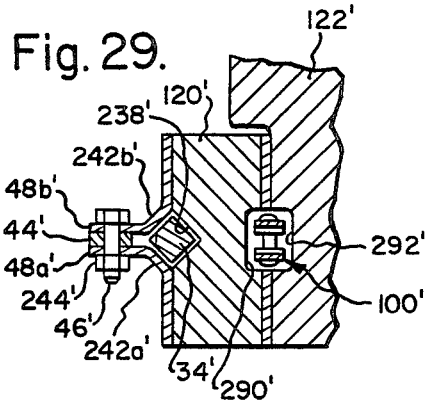
Figure 30:
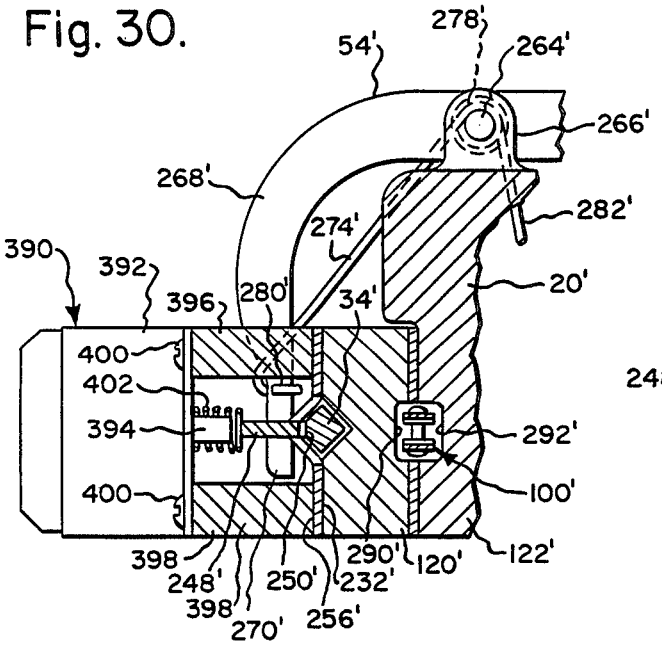
Figure 31:
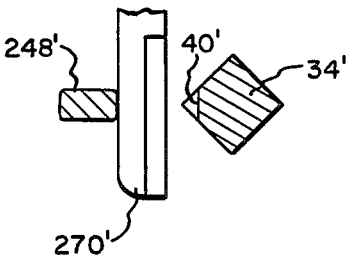

FIGS. 21*a*–21*d* are fragmentary elevational views illustrating various stages of operation of the switch and operator members of the machine of FIG. 20;

FIG. 22 is an enlarged fragmentary elevational view, partly in section, illustrating in further detail the handle grip and associated operator members of the machine of FIG. 20;

FIG. 23 is a fragmentary elevational view, partly in section, taken about on line 23—23 in FIG. 22;

FIG. 24 is a fragmentary elevational view, partly in section, taken about on line 24—24 in FIG. 22;

FIG. 25 is a fragmentary elevational view, partly in section, taken about on line 25—25 in FIG. 22;

FIG. 26 is a sectional view taken about on line 26—26 in FIG. 22;

FIG. 27 is an enlarged fragmentary elevational view, partly in section, illustrating in further detail the arrangement of presser foot shaft, arm, lever and related components of the machine of FIG. 20;

FIG. 28 is a fragmentary sectional view taken about on line 28—28 in FIG. 20;

FIG. 29 is a fragmentary sectional view taken about on line 29—29 in FIG. 20;

FIG. 30 is a fragmentary elevational view, partly in section, taken about on line 30—30 in FIG. 20;

FIG. 31 is a fragmentary sectional view taken about on line 31—31 in FIG. 27; and FIG. 32 is a schematic circuit diagram for the machine of FIG. 20.

DETAILED DESCRIPTION OF THE ILLUSTRATED EMBODIMENTS

Referring now to FIG. 1, there is shown a machine generally designated 10 for cutting sheets of cloth or like material typically arranged in a stack or pile supported on a surface 12 such as the top of a cutting room table. Machine 10 includes a base or foot plate 14 adapted to rest on and to be moved about on surface 12 and to move under the lay of material as machine 10 is guided manually along surface 12. The peripheral portion of base 14 can be curved as shown in FIG. 1 to facilitate movement under the lay of material. In addition, base 14 can be provided with rollers (not shown) on the undersurface thereof to facilitate movement along surface 12. An elongated leg or standard 18 is fixed at one end to the upper surface of base 14 as viewed in FIG. 1 and extends in a direction generally perpendicular to base 14, i.e. vertically as viewed in FIG. 1. The opposite or upper end of leg 18 as viewed in FIG. 1 joins a machine housing generally designated 20. An electric motor 22 is carried by housing 20 and electrical power is supplied thereto through a connector generally designated 24. An elongated cutting blade 26 is movably supported at one end, i.e. the upper end as viewed in FIG. 1, in housing 20 for reciprocating movement in response to operation of motor 22 in a known manner and in a direction toward and away from base 14. The knife blade 26 extends downwardly along standard 18, is spaced a short distance therefrom and terminates in an end 27 spaced a short distance from the upper surface of plate 14, this distance being determined by the length of the reciprocating cutting strokes of blade 26. Blade 26 has a cutting edge 28 extending therealong and facing in a direction opposite that of standard 18. This direction, i.e. to the left as viewed in FIG. 1, is the forward cutting direction of machine 10.

The machine 10 of FIG. 1 further includes a presser foot 30 in the form of a curved metal element which is fixed to one end of a shaft 34 which is movably carried by the machine housing and is disposed generally perpendicular to the plane of base 14. Blade 26 is received between two arms of a fork-like formation at the end of foot 30 in a known manner. Shaft 34 is provided with a handle 36 at the opposite end, i.e. the upper end as viewed in FIG. 1, whereby the presser foot 30 can be moved manually between the solid and broken lines positions shown in FIG. 1 to be set at different levels according to the thickness of the different lays or piles of material to be cut. In particular, shaft 34 is provided with teeth 40 along its length. A pin, tooth or other suitable formation (not shown) in FIG. 1 engages teeth 40 in a ratcheting manner, i.e. allowing movement of shaft 34 in a direction toward the base 14 when allowed to ratchet but preventing movement in the opposite direction. The pin is on an arm or holding means 44 which is pivoted at 46 to a bracket 48 fixed to the housing 20. Arm 44 is biased to place the pin in engagement with the teeth 40 by a spring (not shown in FIG. 1) between a bracket member 50 and the arm 44 as will be described in further detail presently. Arm 44 and hence the pin carried thereby are moved out of engagement with shaft 34 by operation of a lever 54. In particular, one end of lever 54 operatively contacts the lower end of arm 44 and the other end of lever 54 is located for manual operation. The lever 54 is pivotally connected at an intermediate location to the housing 20 as will be described, and it is biased into the position of FIG. 1 whereby the pin on arm 44 engages teeth 40. The person operating the machine can manually operate lever 54 to cause pivoting of arm 44 clockwise or to the left as viewed in FIG. 1 to release shaft 34 and allow the presser foot 30 to fall or drop by gravity from an elevated position toward base 14.

Machine 10 is moved and guided manually along surface 12 by a handle 60. The handle is disposed substantially parallel to the plane of base 14 and extends in a direction away from standard 18 on the side opposite blade 26. Handle 60 is connected to a bracket plate 62 depending from housing 20, connection being made by a longitudinally extending threaded bolt 64 received in a bore through plate 62 and fastened by a nut 66. A hand-grip 70 is fixed to the housing of motor 22 and extends upwardly therefrom to facilitate lifting and carrying of the machine.

Machine 10 is of the type provided with a sharpener assembly generally designated 74 which is carried by housing 20 and normally located adjacent the upper end of blade 26 near the lower portion of housing 20. The sharpener 74 is moved in opposite directions, i.e. down and up along blade 26 as viewed in FIG. 1, by a suitable drive in housing 20 operated by motor 22 whenever sharpening of blade 26 is desired. Sharpening is provided by a pair of abrasive belts 76,78 trained around rollers, two of which are designated 80 and 82, in FIG. 1, connected to plates 84 and 86, respectively, which belts 76, and 78 contact the two faces of blade 26 adjacent the cutting edge 28. The sharpener includes a carriage 88, and movement of sharpener 74 along blade 26 is provided by a shaft 90 extending upwardly from carriage 88 into a mechanism within housing 20 and driven by motor 22. The belts 76,78 are driven by pulleys through the aforementioned rollers, and drive to the belts is provided by shafts from motor 22, one of which is designated 92 in FIG. 1. Sharpener 74 is of a type known in the art, and for a more detailed description of a sharpener of the type shown in FIG. 1, reference may be made to U.S. Pat. No. 2,829,474 issued Apr. 8, 1958 in the name of F. G. Clark entitled "Knife Sharpening Mechanism" and assigned to the assignee of the present invention, hereby incorporated by reference.

The cutting edge 28 of blade 26 is extremely sharp. During cutting operations when machine 10 is operating, the person using the machine is cognizant of the blade 26 and customarily takes adequate precautions. Also, during cutting operations a significant portion of the blade edge 28 is occupied by cutting the stack of cloth, and the shaft 34 extending upwardly from presser foot 30 on top of the stack serves partially as a guard with respect to the remaining portion of the blade edge. When the machine 10 is not in use, however, the exposed edge 28 of blade 26 can pose a safety hazard. If the presser foot 30 is in the down position, i.e. resting on base 14, the shaft 34 can serve as a guard against a person moving his hand or arm inadvertently into contact with blade edge 28. However, shaft 34 is spaced a distance from edge 28, and it would be highly desirable to provide a guard closely adjacent the blade edge 28.

In accordance with this invention, there is provided elongated guard means generally designated 100 operatively connected at one end to presser foot 30 and guidely received in housing 20 for movement with presser foot 30 and having a portion located closely adjacent the cutting edge 28 of blade 26 as the presser foot 30 is moved along the blade 26. As a result, when the presser foot 30 is in the down position, i.e. resting on base 14, the entire length of the blade cutting edge 28 is guarded thereby protecting a person from unintended contact with the blade edge 28. When the presser foot 30 is raised to accommodate a stack of cloth or other sheet material for cutting, the guide means 100 is moved with the presser foot 30 to expose the blade edge 28 for use.

With machine 10 being of the type including the sharpener 74 there is need to adapt the guard means 100 to the presence and operation of the sharpener assembly 74 while at the same time placing the guard means 100 as close as possible to the blade edge 28. In accordance with the present invention, the guard means 100 is flexible and travels in response to movement of presser foot 30 along a path having a first portion closely adjacent the blade edge 28, a second portion offset or spaced therefrom outwardly from the sharpener assembly 74 along housing 20 in a direction generally perpendicular to base 14 and parallel to the first path 14, and a third path portion joining the first and second path portions and extending in a direction generally parallel to base 14 and about along a portion of sharpener 74. The guard means 100 is flexible in directions along a plane which contains the three sections of the aforementioned path. In the present apparatus, the guard means 100 is in the form of a flexible roller chain comprising a series of pins or rollers joined by links in a known manner. The first portion of the path is defined by the location of the presser foot 30 and shaft 34 relative to blade edge 28 and the connection of one end of the guard means 100 to the presser foot 30. The one end of the chain providing the guard 100 is connected to foot 30 in a manner which will be described and at a location such that when foot 30 is raised or lowered as previously described, the chain 100 moves along the blade edge 28 as close as possible without contacing the edge 28 but to effectively cover it when the foot 30 is in the lowermost position, i.e. on or adjacent base 14.

The second portion of the path is defined in housing 20 in the following manner. The other end of the chain forming the guard 100 is connected to a screw eye 108 which is threaded through a bracket 110 extending from housing 20. A spring 112 is received on the other end of screw 108 and a thumb nut 114 is threaded thereon against the force of spring 112. This arrangement connects the chain 100 to the housing 20 and provides adjustment of the tension or amount of slack in the chain. The chain 100 extends from this arrangement along and into a space defined between two sections 120,122 of housing 20 so as to be guided therein in a manner which will be described in further detail presently. The chain extends further in a direction toward base 14 through an opening 123 in the carriage 88 of the sharpener assembly and forwardly of the arrangement of the belt and rollers so as not to interfere with the operation of sharpener 74 during its movement along the blade 26.

The third path portion is defined by a bracket 124 carrying a pair of rollers 126,128 having axes 130 and 132 respectively, spaced apart in a direction substantially parallel to base 14 and slightly offset vertically as shown in FIG. 1. The chain 100 is trained around rollers 126,128 as shown. The rollers are connected to bracket 124 which has a first arm 134 fixed at one end to the sharpener carriage 88 and extending along adjacent the first path and a second arm 136 is disposed at an angle thereto to which the rollers 126,128 are connected in a manner which will be described in further detail presently. The bracket 124 and rollers 126,128 being fixed to sharpener carriage 88 also serves as means to guide the chain 100 away from blade edge 28 as sharpener 74 moves downwardly as viewed in FIG. 1 and to return chain 100 closely adjacent blade edge 28 as sharpener 74 returns upwardly in FIG. 1.

When machine 10 is not in use, the edge 28 of blade 26 usually will not be covered by a stack of sheets of cloth or like material being cut. Therefore, it is important for safety reasons that the presser foot 30 is returned, i.e. lowered to a location resting on base 14. For one reason, shaft 34 by itself provides some guarding function with respect to blade 26. For another reason, since guard 100 is operatively connected to the presser foot 30, returing the foot 30 to a location on base 14 when machine 10 is not in operation places the guard 100 in position for maximum protection or guarding of the blade cutting edge 28.

As previously described, machine 10 includes operator controlled means for holding the presser foot 30 at a selected distance from the base 14 during operation of the machine 10. In accordance with this aspect of the present invention, there is provided means operatively connected to a switch 140 which controls the supply of power to motor 22 and also operatively connected to the aforementioned operator controlled means, for causing the latter to disengage the shaft 34 and hence presser foot 30 when switch 140 is opened to disconnect the motor 22 thereby causing the foot 30 to return or drop by influence of gravity to a position resting on base 14.

In particular, as shown in FIG. 1, handle 60 has first and second operator members for switch 140. The first member 144 is formed from a plate to include a first elongated section 146 which is received in an elongated slot or recess 148 in the handle grip 60 and has a curved edge 150 which conforms generally to the curved surface of the handle grip 60. Section 146 terminates at the outer end in a short leg 152 which is received in a corresponding portion of the recess 148. The inner end of section 146, i.e. the left-hand end as viewed in FIG. 1, meets a second section in the form of a leg 154 which extends at a right angle to section 146 and terminates in a short foot 156 which is located to engage an operator element 160 of switch 140 which element 160 is movable within a sleeve 162 mounted in the housing wall. Member 144 is positioned in recess 148 for movement in a plane parallel to the longitudinal axis of handle 60, i.e. in a plane parallel to the plane of the paper as viewed in FIG. 1. Member 144 is pivotally connected by a pin 164 to a plate 166 fixed to housing 20 and provided with a recess in which a portion of the leg 154 is received. The pivotal movement of member 144 is against the force of a biasing spring 170 fitted in a bore in handle 60 extending from recess 148 and contacting the edge of section 146.

The second operator member 174 for switch 140 also is formed from a plate and is disposed for pivotal movement in a plane perpendicular to the longitudinal axis of handle 60, i.e. perpendicular to the plane of the paper as viewed in FIG. 1. An upper edge portion 176 of member 174 is located to engage operator element 160 of switch 140. Movement of operator member 174 into and out of engagement with element 160 is caused by an extension 178 of member 174 which extension is manipulated by the finger of a person operating machine 10. Member 174 is biased into position engaging switch operator 160 in a manner which will be described, and this position corresponds to opening of switch 140 to disconnect the supply of electrical current to motor 22. In accordance with this aspect of the present invention, member 170 is operatively coupled to lever 54 in a manner which will be described, and when member 170 is in a position corresponding to opening of switch 140, the member 170 holds lever 54 in a position releasing shaft 34 thereby allowing the presser foot 30 to drop to the lowermost position, i.e. resting on base 14.

FIGS. *2a–2d* illustrate various stages of operation of switch element 160 by the operator members 144 and 174. In particular FIG. *2a* shows both foot 156 of member 144 and the upper edge portion 176 of member 174 in engagement with switch element 160 to move it to an open or off condition. FIG. *2b* is an intermediate position where foot 156 is moved out of engagement with element 160 in response to clockwise movement of operator member 144 about pivot 164 as viewed in FIG. 1, and edge 176 of operator member 174 is still in engagement with element 160 holding switch 140 in an open or off position. FIG. *2c* illustrates the on or closed condition of switch 140 when element 160 moves to the right when both foot 156 and edge 176 are moved out of engagement with element 160. Movement of edge 176 is caused by downward pivotal movement of extension 178 as viewed in FIG. 1 to pivot the operator member 174 in a plane perpendicular to the longitudinal axis of handle 60. FIG. *2d* shows the return of the foot 156 and the edge 176 into engagement with element 160 in response to manual release of the operator members 144 and 174.

Figure 3:
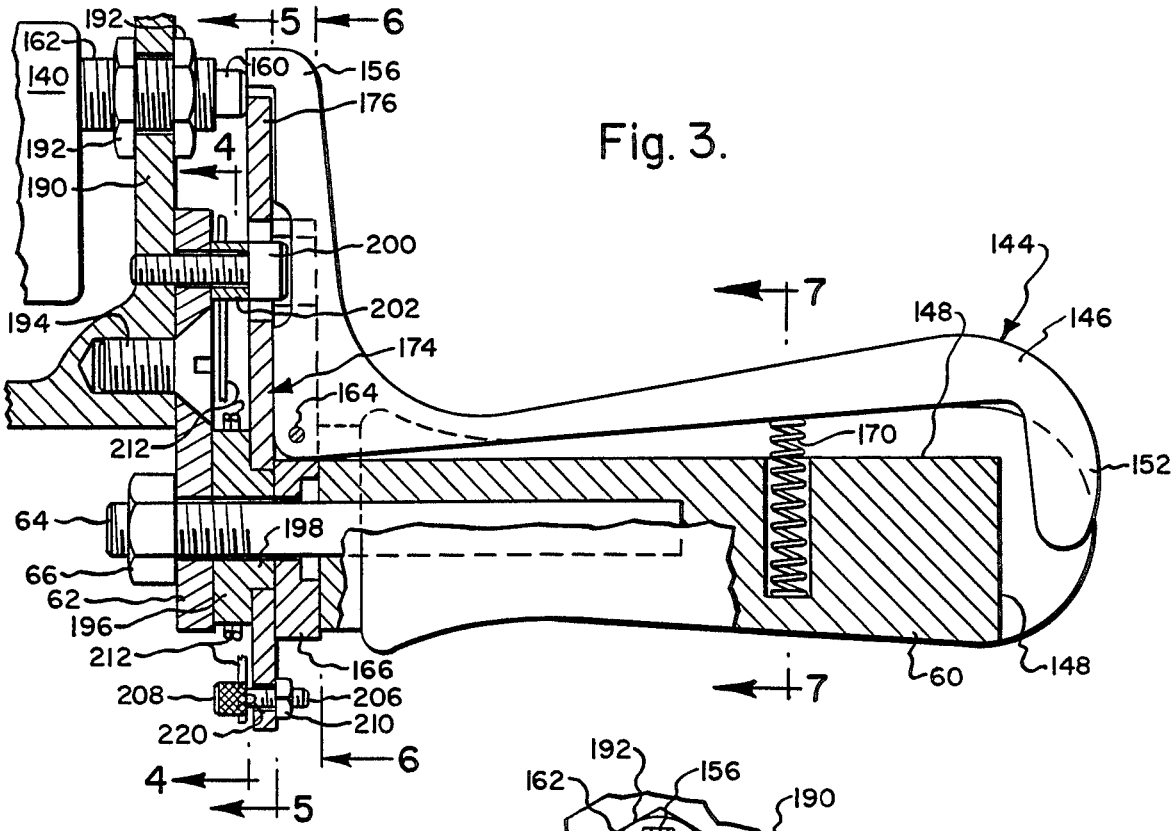
FIG. 3 is an enlarged fragmentary elevational view, partly in section, illustrating in further detail the handle grip and associated operator members in the machine of FIG. 1.

FIG. 3 illustrates in further detail the operator member 144 and handle 60. The sleeve 162 containing switch operator 160 extends through an opening in the housing wall 190 and is fastened thereto by nuts 192 threaded thereon. The bracket plate 62 is fixed to housing wall 190 by a flathead screw 194. A bushing 196 is received on bolt 64 and fitted between plates 62 and 166 and has a smaller diameter section 198 extending in from the end contacting plate 166 which section 198 is rotatably received in an opening in the operator member 174 in a manner which will be described. A socket head screw 200 is threaded partly into plate 62 and housing wall 190 as shown, and partly serves to hold plate 62 in place. A spacer 202 is located on screw 200 and is fitted between the screwhead and the plate 62. The head of screw 200 is received in an elongated opening in operator member 174 and serves as a stop to limit pivotal movement of member 174 as will be described. A screw 206 having a head 208 is received in an opening near the lower edge of member 174 and fastened thereto by a nut 210. A biasing spring 212 has one end contacting the opposite surface of spacer 202 as viewed in FIG. 3, a central portion coiled around the larger diameter section of bushing 196, and an opposite end contacting the opposite surface of screwhead 208 as viewed in FIG. 3. The biasing spring 212 is positioned relative to member 174 to pivot the lower end thereof in a direction out from the plane of the paper as viewed in FIG. 3 as will be described in detail presently.

Figure 4:
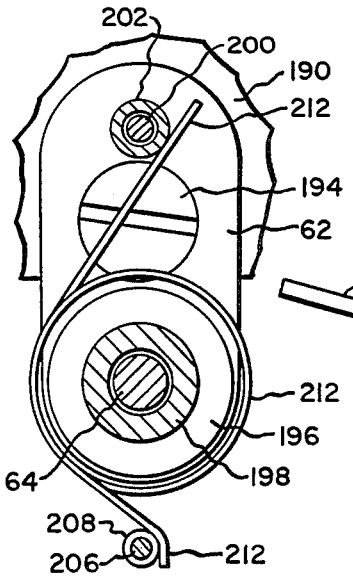
FIG. 4 is a fragmentary elevational view, partly in section, taken about on line 4—4 in FIG. 3.
Figure 5:
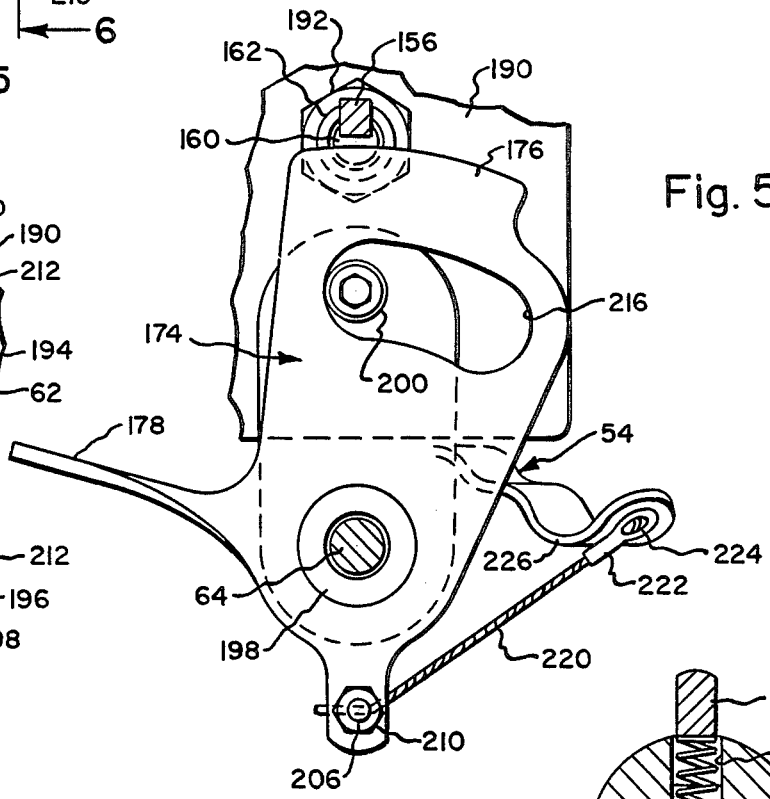
FIG. 5 is a fragmentary elevational view, partly in section, taken about on line 5—5 in FIG. 3.
Figure 7:
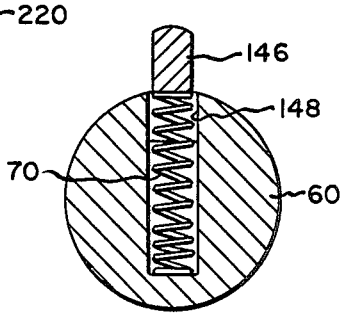
FIG. 7 is a sectional view taken about on lines 7—7 in FIG. 3.

FIGS. 4–6 illustrate in further detail the structure of operator member 174 and associated components. FIG. 4 shows in further detail the manner in which biasing spring 212 has one end contacting spacer 202, the central portion coiled around bushing 196 and the opposite end contacting the screwhead 208. This arrangement of biasing spring 212 applies force to urge the operator member 174 in a clockwise direction pivotally about bushing 196 as viewed in FIG. 4. Referring now to FIG. 5, the operator member 174 is shown in the position of FIGS. *2a*, *2b*, and *2d* where the upper edge portion 176 contacts the switch operator member 160. The biasing spring 212 holds operator member 174 in this position, tending to pivot it in a clockwise direction as viewed in FIG. 5 and a rest position of member 174 is established by engagement between the socket head screw 200 and one end of the elongated slot 216 provided in member 174 near the upper edge portion 176. In this initial position to which member 174 is biased, the extension 178 is in the uppermost position. Member 174 is operatively connected to the lever 54 by means of a line or cable 220 fixed at one end to member 174 in the following manner. The end of line 220 is fitted in a lateral bore in the screw 206 and then is held between the screwhead 208 and the surface of member 174 upon tightening of screw 206 with nut 210. The opposite end of line 220 is fixed to lever 54 by means of an eyelet 222 joined to the end of the line 220 and secured by a fastener 224 to an offset end portion 226 of lever 54.

Thus, in this initial position of operator member 174 and extension 178, which corresponds to the off condition of switch 140 and denergization of motor 22, lever 54 is held in a position such that arm 44 is pivoted to move the pin or detent thereof out of engagement with teeth 40 so that shaft 34 is free and the presser foot 30 is allowed to move downwardly by gravity to the lowermost position, i.e. resting on base 14. When the extension 178 is moved downwardly as viewed in FIG. 5 when the person operating machine 10 grasps handle 60 and also urges operator member 154 down to operate the machine, the member 174 pivots in a counterclockwise direction as viewed in FIG. 5 to slacken the line 220 and allow lever 54 to return and the arm 44 to return the pin or detent thereof into engagement with teeth 40 to hold shaft 34 and thus maintain the presser foot 30 in any selected raised position during operation. This pivotal movement of operator member 174 in a counterclockwise direction is limited by engagement between the head of socket screw 200 and the other end of the elongated slot 216 shown in FIG. 5. Thus, mechanical means operatively connected to member 174 and operatively engaging holding means 44 causes the holding means to release presser foot 30 when member 174 is pivoted to the lower position.

FIGS. 8–12 illustrate in further detail the arrangement of presser foot shaft 34, arm 44, lever 54 and related components. Movement of presser foot shaft 34 is guided by extensions of housing 20 including the lower portion 120 having a vertical surface 232 as viewed in FIG. 8. A pair of brackets 234,236 are vertically spaced along surface 232 defining with the surface openings to receive shaft 34. As shown in FIG. 9, a recess 238 in surface 232 cooperates with bracket 234 to define an opening to receive and guide shaft 34. A similar arrangement is provided between recess 238 and bracket 236. Thus, movement of shaft 34 is guided by cooperation between recess 238, surface 232 and the brackets 234,236. The upper housing bracket 110 has a lower surface 240 which abuts the end of shaft 34 in its uppermost position as illustrated in FIG. 1 thereby serving as a stop.

As shown in FIG. 10, bracket 48 comprises a pair of generally L-shaped portions 48*a*,48*b* fixed to housing extension 120 with the legs of each L portion joined by angularly disposed sections 242*a*,242*b* whereby these sections cooperate with recess 238 to define an opening to accommodate shaft 34. The upper end of arm 44 is received between sections 48*a*, 48*b* and pivotally connected to a bolt 46 secured by a nut 244. As shown in FIG. 8, arm 44 has an offset section 248 about midway between the ends thereof having a surface 250 provided with a tooth, detent or other suitable formation to engage the teeth 40 of shaft 34. Bracket 50 is in the form of an angle iron as shown in FIG. 11 and has one leg 252 parallel to surface 250, a second leg 254 extending at a right angle to leg 252 and toward the surface 250 and a third leg 256 extending at a right angle to the second leg 254 in a direction away from leg 252 for mounting on surface 232. A biasing means in the form of a coil spring 260 is located between the bracket leg 252 and the arm offset portion 248 and urges the tooth or detent on surface 250 into engagement with teeth 40 of shaft 34.

As shown in FIG. 11, lever 54 is pivotally connected between the ends thereof by means of pin 264 connected to lever 54 and received in a bracket 266 fixed to the portion 122 of housing 20. The one end of lever 54 terminates in offset portion 226 as previously described. The opposite end of lever 54 includes a curved arm portion 268 which terminates in a finger 270 which contacts the surface of arm 44 facing shaft 34 as shown also in FIG. 8. A biasing spring 274 has a central coil portion 278 which is wound around pin 264, one end portion 280 which is hooked or otherwise connected to finger 270, and an opposite end portion 282 which is fixed to housing 20 in an appropriate manner. Spring 274 biases lever 54 into the position illustrated into FIG. 11 where finger 270 is located closest to the shaft 34. This allows engagement between the shaft teeth 40 and the tooth or detent on arm offset surface 250. Upon tightening of line 220, such as when the machine is shut off and member 174 pivots clockwise as viewed in FIGS. 5 and 6, the offset end 226 is moved closer to housing 20 as viewed in FIG. 11 and the finger 270 is moved in a direction away from shaft 34 consequently moving the surface 250 and formation from engagement with the shaft teeth 40. As previously descirbed, this frees the shaft 34 allowng the presser foot 30 to fall by gravity to its lowermost position, i.e. contacting the base 14.

As shown in FIGS. 8–10, movement of the guard 100 or a roller chain is guided relative to housing 20 by opposed longitudinal recesses 290,292 in the housing portions 120, 122, respectively, the recess being of generally rectangular cross section, in substantial alignment, and extending generally vertically as viewed in FIG. 8.

FIGS. 13–15 illustrate in further detail the guard 100 and related components. In particular, FIG. 13 shows in further detail the manner in which chain 100 is guided by rollers 126, 128 which are connected to bracket 124. Also, FIG. 13 illr:strates the manner in which the spaced-apart links of chain 100 are in close, nearly straddling relation to blade edge 28 thereby blocking or guarding the blade edge 28 from unwanted exposure or contact with objects. FIG. 14 details one of the rollers, i.e. roller 128 showing the connection by a pin 294 and a series of needles 296 between pin 294 and the roller shell. FIG. 15 shows an illustrative connection of the one end of chain 100 to presser foot 30. An upstandir:g leg 298 is fixed at one end to the upper surface of foot 30 in the neighborhood of one of the two forks 300, 302 of the foot 30. The last link of the chain on the end is pivotally connected to leg 298 by a pin 306 and spaced therefrom by a sleeve 308.

FIGS. 16 and 17 illustrate an alternative form of chain to serve as the guard. In this embodiment, the chain generally designated 310 comprises a plurality of pins 311 joined by a plurality of links 312. Each link 312 has a first longitudinal straight edge 314, rounded edges 316 and 318 at the opposite ends, and is characterized by an extension 320 along the opposite longitudinal edge, commercially available from Morse as ANSI S-2 attachments. In particular, the extension is generally rectangular in shape, having a longitudinal outer straight edge 322, and a pair of lateral edges 324, 326 extending inwardly from theouter edge 322 and meeting corresponding ones of the curved end edges 316 and 318. The chain 310 is located so that the extensions 320 straddle the cutting edge of the knife blade as shown in FIG. 17. This enhances the guarding function of chain 310. In particular, whereas chain 100 is positioned such that the edges of the limbs are substantially in alignment with the blade edge 28 as shown in FIG. 13, the blade edge 28 is located within the extension 320 of chain 310 inwardly of the outer edges thereof in the arrangement of FIGS. 16 and 17.

FIGS. 18 and 19 illustrate another form of flexible guard as an alternative to the chains of the previous embodiments. The guard 330 of this embodiment is in the form of a channel member of flexible material such as a suitable plastic, having a continuous web 332 along the entire length thereof and having equally spaced and equally sized arm segments 334 along both opposite edges of the web 332 and in substantial lateral alignment. Each arm segment includes an outer edge 336 which is disposed parallel to web 332 and a pair of side edges 338,340 extending inwardly from edge 336 in a direction generally perpendicular to the edge and to the web 332. Adjacent arm segments are in closely-spaced relation. The web 332 is guided along the paths including the rollers similar to the chains of the previous embodiments. The guard 330 likewise is positioned so that the arm segments 334 straddle the cutting edge 28 of the blade 26 as shown in FIG. 19 thereby enhancing the guarding function in a manner similar to chain 310 shown in FIGS. 16 and 17. Another alternative form of guard could be a ribbon of metal, plastic or other flexible material. Thus, it would resemble the web 332 in FIGS. 18 and 19 with arms 334 removed, and it would be located closely adjacent blade edge 28.

Machine 10 with the safety features of the present invention is operated in the following manner. When machine 10 is at rest and motor 22 is off, typically base 14 rests on supporting surface 12 in the manner shown in FIG. 1. Presser foot 30 is in the lowermost position, i.e. resting on base 14, as shown in broken lines in FIG. 1. This location of presser foot 30 is maintained by the arrangement of operator member 174, line 220 and lever 54 as previously described. In other words, if handle 36 at the upper end of shaft 43 is grasped and the presser foot 30 is raised, as soon as the handle is released the presser foot 30 falls by gravity because the teeth 40 of shaft 34 are not engaged by the pin or detent on arm 44 as previously described. With presser foot 30 in the lowermost position, the chain or guard 100 extends along and closely adjacent to the blade cutting edge 28 thereby effectively guarding and covering it from exposure to persons or objects encountering machine 10. The shaft 34 also serves to block movement of objects into proximity with the blade cutting edge.

When it is desired to turn motor 22 on to operate machine 10, the user grasps handle 60 to depress the member 154 and simultaneously pivots member 174 by using his finger to manipulate extension 178. This moves the operator members 154 and 174 to the position of FIG. 2c allowing switch operator 160 to move to close the switch 140 to supply electrical power to operate motor 22 and reciprocate blade 26 for cutting, The movement of operator member 174 slackens the line 220 as previously described allowing lever 54 to be biased into position allowing arm 44 to move the detent or pin carried thereby into engagement with teeth 40 of shaft 34. Then, presser foot 30 can be raised by means of handle 36 to an appropriate height to accommodate the thickness of the stack or pile to be cut. This is permitted by the ratcheting engagement between the detent or pin carried by arm 44 and the shaft teeth 40. This engagement maintains foot 30 in whatever position it is raised to by the handle 36. When presser foot 30 is raised, guard 100 also is moved along the path and the blade edge 28 is exposed in the region between the foot 30 and the base 14. Such position is illustrated in solid lines in FIG. 1.

With motor 22 on, the guard 100 raised, the presser foot 30 raised, and the blade exposed and reciprocating, cloth can be cut using machine 10 in a known manner. When it is desired to lower pressure foot 30, such as when cutting a stack of smaller thickness, lever 54 is moved by hand to allow the presssure foot 30 to drop by gravity to a lower position accommodating the smaller thickness, presser foot 30 is of course raised simply by raising handle 36 as previously described. Machine 10 continues to operate as long as the user maintains the operator members 154 and 174 in the positions corresponding to FIG. 2c. When it is desired to shut off the machine 10, the user simply releases operator members 154 and 174 to return them to the positions of FIGS. 2d and 2a. This moves the switch operator 160 to a position opening switch 140 to shut off the motor 22. Release of operator member 174 allows biasing spring 212 to return it to the position of FIGS. 5 and 6. This, in turn, tightens line 220 and moves lever 54 to move arm 44 and the pin or detent thereof out of engagement with the teeth 40 of presser foot shaft 34. The presser foot 30 thus falls by gravity to the lowermost position, i.e. resting on base 14 as shown in dotted lines in FIG. 1. This also moves guard 100 along the exposed edge of the knife blade for protection thereof as previously described.

When it is desired to operate the sharpener 74, it is moved from the rest position as shown in FIG. 1 along the blade 26 in a direction toward the base 14 and then returns to the rest position. Sharpening of blade 26 is done by the moving abrasive belts 76,78 in a known manner. The bracket 124, being carried by the sharpener and having arm 136 and rollers 126,128 located in spaced relation to sharpener 74 forwardly thereof relative to movement along blade 26 toward base 14, moves the guard 100 away from the blade edge 28 in advance of the moving sharpener assembly. This exposes blade edge 28 for operation thereon by sharpener 74 and defines a space between blade 26 and guard 100 to accommodate sharpener 74. When the sharpener returns toward the rest position of FIG. 1, bracket 124 moves the flexible guard 100 back to the guarding position along the blade edge 28. This is because arm 136 and rollers 126,128 are located rearwardly of sharpener 74 relative to return movement of sharpener 74 in a direction away from base 14 toward the rest position. Thus, the foregoing accommodation is provided by the flexiblity of guard 100 and the guide means in the form of bracket 124 including rollers 126,128 which guide means is carried by sharpener 74 for movement therewith.

Thus, the guard 100 when in place advantageously is relatively close to blade edge 28 thereby maximizing the protection provided thereby. The presence of guard 100 makes the blade edge 28 inaccessible to persons or objects, the entire length of blade edge 28 when machine 10 is not operating and presser foot 30 is down, and the portion between foot 30 and housing 20 when machine 10 is operating and foot 30 is up. Furthermore, guard 100 automatically is moved into place protecting blade edge 28 when machine 10 is turned off, this being in conjunction with the automatic lowering of presser foot 30 when machine 10 is turned off. The foregoing is provided in a manner readily accommodating the presence and operation of sharpener 74. In addition, the provision of the two operator members 154 and 174 assures that machine 10 is not placed in operation simply when handle 60 is gripped, but that some additional voluntary action is required by the person using machine 10 to place it in operation.

FIGS. 20–32 show a straight knife machine having safety features according to another embodiment of the present invention. The straight knife machine in FIGS. 20–32 is substantially similar to machine 10 shown in FIGS. 1–19 and, therefore, like components in the machine of FIGS. 20–32 are identified by the same reference numerals as those in FIGS. 1–19 but with a prime designation. Thus, machine 10' shown in FIG. 20 includes a leg or standared 18' extending up from a base (not shown) identical to base 14 of machine 10 of FIGS. 1–19 and joining a housing 20' which carries an electric motor 22'. An elongated cutting blade 26' having a cutting edge 28' is reciprocated by a mechanism driven by motor 22' and extends downwardly along a standard 18' in a manner identical to blade 26 in the machine 10 of FIGS. 1–19. A presser foot 30' has a fork-like formation at one end straddling blade 26' and is connected at the other end to the lower end of a shaft 34' which is manually operable to move the foot 30' along blade 26' in a manner identical to that of machine 10 in FIGS. 1–19.

As in the previous embodiment, shaft 34' also is provided with teeth 40' which engage in a ratcheting manner a pin, detent, tooth or other suitable formation on an arm 44' pivotally connected at 46' to a bracket 48' fixed to housing 20'. Arm 44' is biased to place the pin thereon in engagement with teeth 40' in a manner different from that of the previous embodiment and which will be described in detail presently. Arm 44' and the pin or formation carried thereby are moved out of engagement with shaft 34' by operation of a lever 54', one end of which contacts the lower end of arm 44' and the other end of which is located for manual operation in a manner similar to that of lever 54 of machine 10 in FIGS. 1–19. The machine 10' is moved and guided manually along a surface similar to surface 12 in FIG. 1 by a handle 60' connected to a bracket plate 62' by a threaded bolt 60' received in a bore through plate 62' and fastened by a nut 66'.

A sharpener assembly 74' is carried by housing 20' adjacent the upper end of plate 26' and moved down and up along blade 26' as viewed in FIG. 20 when sharpening is desired in a manner identical to sharpener assembly 74 in machine 10 of FIGS. 1'19. Sharpener 74' includes a pair of abrasive belts 76' 78' trained around rollers connected to plates 84',86' and also includes a carriage 88' connected to a shaft 90' which moves the sharpener assembly 74' along the blade 26' in a manner like that of sharpener 74 in machine 10 of FIGS. 1–19.

Machine 10' shown in FIG. 20 includes an elongated guard means 100' closely adjacent blade edge 28' operatively connected at one end to presser foot 30' and guidedly received in housing 20' for movement with the presser foot 30' for protecting blade edge 28' in a manner like guard 100 in the machine of FIGS. 1–19. Guard 100' is flexible and shown in the form of a chain similar to guard 100 illustrated in FIGS. 1–19 and likewise travels along a path having the same three sections closely adjacent blade 28', along housing 20' and around sharpener 74'. There is provided a bracket 124' carrying a pair of rollers 126',128' around which chain 100' is trained, and the bracket 124' has first and second arms 134' and 136'. The bracket 124' with rollers 126',128' also serves to guide the chain 100 away from the blade edge 28' as the sharpener 74' is moved along blade 26' as in machine 10 of FIGS. 1–19.

Machine 10' of this embodiment likewise includes means to cause return of pressure foot 30' to the rest position on or adjacent the base when motor 22' is turned off to maintain guard 100' in a position protecting blade edge 28' when machine 10' is not in use. In particular, handle 60' has first and second operator members for switch 40'. The first member 350 is formed from a plate to include a first elongated section 352 which is received in an elongated slot or recess 354 in handle 60' and has a curved edge 356 which conforms generally to the curved surface of handle 60'. Section 352 terminates at the outer end in a short leg 358 which is received in a corresponding portion of the recess 354. The inner or left hand end of section 352 as viewed in FIG. 20 meets a second section or leg 360 which extends at about a right angle thereto and terminates in a short foot portion 362 which is adapted to engage an operator member 160' of switch 140' which is movable within a sleeve 162' mounted in the housing wall. Operator member 350 is positioned in recess 354 for movement in a plane parallel to the longitudinal axis of handle 60', i.e. in a plane parallel to the plane of the paper as viewed in FIG. 20. Operator member 350 is pivotally connected by a pin 364 to a plate 166' fixed to housing 20' and provided with a recess in which a portion of the leg 360 is received. The pivotal movement of member 350 is against the force of a biasing spring 370 received in a bore in handle 60'.

A second operator member 374 for switch 140' also is formed from a plate and is disposed for pivotal movement in a plane perpendicular to the longitudinal axis of handle 60'. i.e. perpendicular to the plane of the paper as viewed in FIG. 2. A finger-like extension 376 of member 374 is located to engage the operator member 160' of switch 140'. Movement of the operator member 374 into and out of engagement with element 160' is caused by an extension 378 of member 374 which extension is manipulated by the finger of a person operating the machine 10' and is similar to extension 178 of operator member 174 in machine 10 of FIGS. 1–19. Member 374 is biased into a position engaging switch operator 160' in a manner which will be described, and that position corresponds to opening of switch 140' to disconnect the supply of electrical current to motor 22'.

Figure 21A:
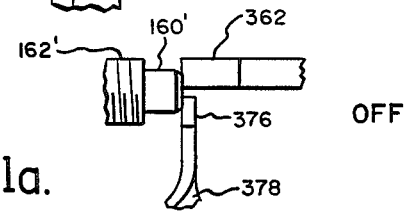
Figure 21B:
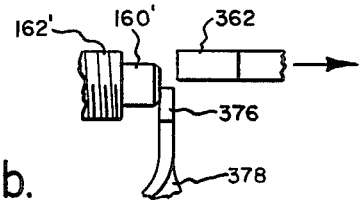
Figure 21C:
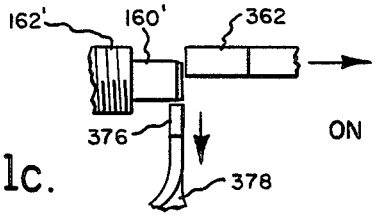
Figure 21D:
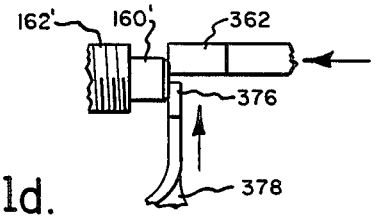

FIGS. **21*a*–21*d* illustrate various stages of operation of switch element 160' by the operator members 350 and 374, similar to FIGS. 2*a*–2*d*. In particular, in the switch open or off condition of FIG. 21*a*, foot 362 of operator member 350 and finger 376 of member 374 are in engagement with element 160'. FIG. 21*b* is an intermediate position where foot 362 is moved out of engagement with element 160' in response to clockwise movement of operator 350 about pivot 364, and finger 376 of operator member 374 still is in engagement with element 160' holding switch 140' in an open or off position. FIG. 21*c* illustrates the on or closed position of switch 140' where element 160' moves to the right when both the foot 362 and finger 376 are moved out of engagement with element 160'. Movement of finger 376 is caused by downward movement of extension 378 as viewed in FIG. 20 to pivot the operator member 374 in a plane perpendicular to the axis of handle 60'. FIG. 21*d* shows the return of foot 362 and finger 376 into engagement with element 160' in response to manual release of the operator members 350 and 374**.

FIG. 22 illustrates in further detail the operator member 350 and handle 60'. The sleeve 162' containing switch operator 160' extends through an opening in the housing wall 190' and is fastened thereto by nuts 192'. The bracket plate 62' is fixed to housing wall 190' by a flathead screw 194'. A bushing 380 is received on bolt 64' and has one axial end face abutting plate 62', a first diameter section extending axially therefrom and meeting a second, slightly larger diameter section which, in turn, meets an annular flange or rim terminating in the opposite end face which abuts plate 166'. The second diameter section is rotatably received in an opening in the operator member 374 in a manner which will be described. A socket head screw 200' is threaded partly into plate 62' and housing wall 190' as shown and partly serves to hold plate 62' in place. A spacer 202' is located on screw 200' and is fitted between the screwhead and plate. The head of screw 200' is received in an opening in operator member 374 and serves as a stop to limit pivotal movement of member 374 as will be described. A biasing spring 384 has a central portion coiled around the annular rim or flange of busing 380, has a leg 385 at one end fixed to the stationary plate 166'. The biasing spring is positioned to pivot the upper end of the operator member 374 in a direction into the plane of the paper as viewed in FIG. 22 and as will be described.

FIGS. 23–25 illustrate in further detail the structure of operator member 374 and associated components. FIG. 23 details the arrangement of plate 62', bolt 64', socket head screw 200' and housing wall 190'. Referring now to FIG. 24, the operator member 374 is shown in the position of FIGS. 21*a*, 21*b* and 21*d* where finger 376 contacts the switch operator element 160'. The biasing spring 384 holds operator member 374 in this position tending to pivot it in a clockwise direction as viewed in FIG. 24 and a rest position of operator member 374 is established by engagement between the sockethead screw 200' and a portion of the edge of finger 376 adjacent the main body of operator 374. This portion meets a curved edge portion 387 defining therewith a recess to accommodate the sockethead screw and dimensioned or sized to accommodate movement of finger 376 into and out of engagement with which operator element 160'. In this initial position to which operator member 374 is biased, the extension 378 is in the uppermost position. When extension 378 is moved downwardly to the broken line position as shown in FIG. 24, when the person operating machine 10' grasps handle 60' and manually urges operator member 350 down to operate the machine, the member 370 pivots in a counterclockwise direction as viewed in FIG. 24 until the head of sockethead screw 200 engages edge 387. This position of member 374 is illustrated in broken lines in FIG. 24 and corresponds to FIG. 21*c* where finger 376 is out of engagement with the switch operator element 160'.

FIGS. 27–31 illustrate in further detail the arrangement of presser foot shaft 34', arm 44', lever 54' and related components. As shown in FIGS. 27–29, movement of presser foot shaft 34' is guided by extensions of housing 20', brackets, and a recess in the housing surface in a manner identical to that in machine 10 in FIGS. 1–19. Similarly, movement of the guard or chain 100' is guided relative to housing 20' by opposed longitudinal recesses in the housing in a manner identical to that of machine 10 in FIGS. 1–19. As shown in FIGS. 27 and 29, the upper end of arm 44' is received between bracket sections 48*a*,48*b* and pivotally connected to a bolt 46' secured by a nut 244'. Arm 44' has an offset section 248' about midway between the ends thereof having a surface 250' provided with a tooth, detent or other suitable formation to engage the teeth 40' of the shaft 24' in a manner identical to machine 10 in FIGS. 1–19. As shown in FIG. 30, lever 54' is pivotally connected between the ends thereof by means of pin 264' connected to lever 54' and received in a bracket 266' fixed to a portion of housing 20'. The one end of lever 54' terminates near handle 60' to facilitate manual operation of the user. The opposite end of lever 54' includes a curved arm portion 268' which terminates in a finger 270' which contacts the surface of arm 44' facing shaft 34' as shown also in FIG. 27.

Machine 10' likewise includes means for releasing the pressure foot 30' when motor 22' is turned off. In this embodiment there is provided biasing means including electrically operated means responsive to operation of motor 22' for releasing presser foot 30' when motor 22 is turned off. The electrically operated means is in the form of solenoid 390 including a coil within housing 392 and an armature or plunger 394 extending from housing 392. Housing 392 is mounted on a bracket formation including a pair of legs 396,398 extending from housing 20' and secured to a flange of solenoid housing 392 by fasteners 400. Plunger 394 extends from housing 392 in a direction toward arm 44'. A coil spring 402 is connected at one end to plunger 394 and at the other end contacts arm 44'. Solenoid 390 is arranged so that in the denergized condition the end of plunger 394 is spaced from arm 44' and in the energized condition plunger 394 moves toward arm 44' and urges spring 402 against arm 44' to hold the tooth or detent on surface 205' in engagement with shaft 34'.

FIG. 32 shows a circuit for supplying electrical power to motor 22' and solenoid 390 under control of switch 140'. Switch 140' includes a pair of arms 410,412 which simultaneously engage contacts 414,416 when switch 140' is moved from the open position shown in FIG. 32 to a closed position. In the open position of switch 140' shown in FIG. 32, motor 22' is off and solenoid 390 is deenergized. When switch 140' is moved to a closed position with arms 410 and 412 engaging contacts 414 and 416, respectively, line voltage from conductors 420,422 is applied to motor 22' and to the coil 424 of solenoid 390. In particular, a circuit is completed from conductor 422 through conductor 426, through motor 22', conductor 428, switch 420. Simultaneously, a circuit is completed from conductor 422 through conductor 432, switch contact 416, switch arm 413, conductor 434, relay coil 424, conductor 436 and conductor 430 to conductor 420. The open position of switch 140' corresponds to the relative positions of switch operator element 160', foot 362 of operator member 350 and finger 376 of member 374 shown in FIGS. 21*a*, 21*b* and 21*d*. The closed position of switch 140' corresponds to the relative positions of those components in FIG. 21*c*.

Machine 10' with the safety features of this embodiment of the present invention operates in the following manner. As in the machine 10 of the previous embodiment, in the rest condition with motor 22' off and the base resting on a supporting surface, the presser foot 30' is in the lowermost position, resting on the machine base. This location of presser foot 30' is maintained by the arrangement of solenoid 390 and biasing spring 402 as will be described. Thus, if the handle of the upper end of shaft 34' is grasped and the presser foot 30' is raised, as soon as the handle is released the presser foot falls by gravity because the teeth 40' of shaft 34' are not engaged by the pin or detent on arm 44'. With presser foot 30' in the lowermost position, guard 100' is in position of maximum protection relative to blade edge 28', extending along and closely adjacent to it, as in the previous embodiment. Shaft 34' also provides some protection as before.

When it is desired to turn motor 22' on to operate machine 10' the user grasps handle 60' to depress the member 350 and simultaneously depresses member 374 by using his finger to manipulate extension 376. This moves the operator members 350 and 374 to the position of FIG. 21c allowing switch operator 160' to move and close switch 140' to supply electrical power to operator motor 22' and to reciprocate blade 26' for cutting. Closing of switch 140' also energizes solenoid 390 moving plunger 394 in a direction toward arm 44' urging the pin thereon into engagement with the teeth of shaft 34'. The energized solenoid 390 causes the biasing spring to hold arm 44' in this position. Then presser foot 30' can be raised by means of the handle on shaft 34' to accommodate various stack thicknesses as previously described. In particular, this is permitted by the ratcheting engagement between the tooth or extension carried by arm 44' and the shaft teeth 40', and the engagement maintains foot 30' in whatever position it is raised to as a result of the biasing action of solenoid 390. When presser foot 30' is raised, guard 100' also is moved along the path and the blade edge 28' is exposed in the region between the raised foot 30' and the machine base. Such raised position of foot 30' is shown in FIG. 20.

With motor 22' on, guard 100' raised, presser foot 30' raised and blade 26' exposed and reciprocating, cloth can be cut using machine 10' in a known manner. When it is desired to lower presser foot 30', such as when cutting a stack of smaller thickness, lever 54' is moved by hand to move arm 44' away from shaft 34' and against the force of spring 402. This, in turn, allows presser foot 30' to drop by gravity to a lower position accommodating the smaller stack thickness. To accommodate stacks of greater thickness, presser foot 30' is raised by the means of the handle on shaft 34' as previously described. Machine 10' continues to operate as long as the user maintains the operator members 350 and 374 in the positions corresponding to FIG. 21c. When it is desired to shut off the machine 10', the user simply releases the operator members 350 and 374 to return them to the positions of FIGS. 21a or 21d. This moves the switch operator 160' to a position opening switch 140' to shut off motor 22' and deenergize solenoid 390. As a result, the plunger 394 is no longer forces spring 402 against arm 44' and the force of spring 274 predominates urging arm 44' to the outward position and pin or detent thereof out of engagement with the teeth of presser foot shaft 34'. The presser foot 30' thus falls by gravity to the lowermost position, i.e. resting on the machine base, and this also moves guard 100' along the exposed edge of the knife blade for protection thereof.

The sharpener 74' and the manner in which it is accommodated by guard 100' operate in a manner identical to that of machine 10 shown in FIGS. 1–19. The machine 10' of this embodiment has all the advantages of machine 10 of the present embodiment of FIGS. 1–19.

It is therefore apparent that the present invention accomplishtes its intended objects. While embodiments of the present invention have been described in detail, that is for the purpose of illustration, not limitation.

I claim:

1. In a cutting machine comprising a housing having a base spaced therefrom, a motor carried by said housing, a knife blade having a cutting edge and carried by said housing for reciprocal movement generally normal to said base in response to operation of said motor, and presser foot means movably carried by said housing located in spaced relation to said blade cutting edge and movable toward and away from said base, the improvement comprising:

elongated guard means operatively connected to said presser foot means and located closely adjacent said blade cutting edge and guidedly supported in said housing for movement along said blade edge into and out of guarding relation to said blade edge in response to movement of said presser foot means toward and away from said base, said guard means having a central portion disposed substantially parallel to said blade cutting edge and of substantially constant width along the entire length thereof and having a pair of spaced-apart substantially mutually parallel side portions extending in the same direction from said central portion and in substantially straddling relation to said blade cutting edge.

2. Apparatus according to claim 1, wherein said guard means is flexible and travels along a path having a first portion closely adjacent said blade cutting edge, a second portion offsest from said first portion and located in said housing and a third portion joining said first and second portions.

3. Apparatus according to claim 1, wherein said guard means is in the form of a channel member of flexible material having a continuous web along the entire length thereof and closely spaced arm segments along both opposite edges of the web, said arm segments extending from the same surface of said web and substantially perpendicular thereto, said web being disposed substantially perpendicular to the plane of said blade and said arms are in straddling relation to said blade edge.

4. Apparatus according to claim 1 further including blade sharpening means movably carried by said housing normally located near the end of said blade opposite said base and movable along said blade toward and away from said base during sharpening of said blade, said guard means being flexible and travelling along a path having a first portion closely adjacent said blade cutting edge, a second portion offset from said first portion and located in said housing and a third portion joining said first and second portions and extending around said sharpening means.

5. Apparatus according to claim 4, further comprising guide means carried by said sharpening means for moving said guard means away from said blade cutting edge as said sharpening means moves therealong and for returning said guard means closely adjacent said blade cutting edge as said sharpening means returns to its normal location.

6. Apparatus according to claim 5 wherein said guide means comprises bracket means connected to said sharpening means and a pair of roller means rotatably connected to said bracket means in spaced relation along said second portion of said path, said guard means being trained around said rollers.

7. Apparatus according to claim 1, wherein operation of said motor is controlled by switch means, wherein said presser foot means is normally freely movable toward and away from said base, wherein said machine includes means for holding said presser foot means at selected distances from said base during operation of said machine, and further including means operatively connected to said switch means and connected in controlling relation to said holding means for releasing said holding means when said motor is deenergized to maintain said presser foot in a position near said base when said motor is deenergzied.

8. In a cutting machine comprising a housing having a base spaced therefrom, a motor carried by said housing, switch means for controlling operation of said motor, a knife blade having a cutting edge and carried by said housing for reciprocal movement generally normal to said base in response to operation of said motor, presser foot means movably carried by said housing located in spaced relation to said blade cutting edge and normally freely movable toward and away from said base, and means for holding said presser foot means at selected distances from said base during operation of said machine, the improvement comprising:

means operatively connected to said motor control switch means and connected in controlling relation to said holding means for releasing said holding means when said motor is deenergized by action of said motor control switch means to maintain said presser foot in a position near said base when said motor is deenergized, said means for releasing said holding means comprising operator means normally in a first position where said switch means is open and movable to a second position where said switch means is closed; and mechanical means operatively connected to said operator means and operatively engaging said holding means in a manner such that when said operator means is in said first position said mechanical means causes said holding means to release said presser foot means.

9. Apparatus according to claim 8, wherein said means for releasing said holding means comprises:

(a) first biasing means including electrically operated means operatively connected in controlled relation to said switch means and operatively contacting said holding means for causing said holding means to hold said presser foot means at a selected location when said switch means is closed and said motor is operating; and (b) second biasing means operatively connected to said holding means for causing said holding means to release said presser foot means when said switch means is open and said motor is off.

10. Apparatus according to claim 9, wherein said electrically operated means comprises a solenoid having a housing supported by said machine housing, a coil connected electrically to said switch means and a plunger operatively contacting said holding means.

11. Apparatus according to claim 8, further including elongated guard means operatively connected to said presser foot means and located closely adjacent said blade cutting edge and guidedly supported in said housing for movement along said blade edge into and out of guarding relation to said blade edge in response to movement of said presser foot means toward and away from said base, said guard means being in maximum guarding relation to said blade when said presser foot is in said position near said base.

12. Apparatus according to claim 11, wherein said guard means is flexible and travels along a path having a first portion closely adjacent said blade cutting edge, a second portion offset from said first portion and located in said housing and a third portion joining said first and second portions.

13. In a cutting machine comprising a housing, a motor carried by said housing, switch means for controlling operation of said motor and having an operator member movable between first and second positions corresponding to closing and opening of said switch means, a knife blade carried by said housing for reciprocal movement in response to operation of said motor, and an elongated handle having a longitudinal axis for manually guiding said machine during cutting:

(a) a first operator member mounted for pivotal movement in a plane substantially parallel to said handle longitudinal axis, said operator member having a first portion extending along said handle for manual operation and a second portion extending at an angle to said first portion and terminating in a formation operatively engaging said switch operator member;

(b) means for biasing said first operator member in a position placing said switch operator member in said second position and allowing pivotal movement of said first operator member to a position placing said switch operator member in said first position;

(c) a second operator member mounted for pivotal movement in a plane substantially perpendicular to said handle longitudinal axis, said operator member having a first portion located relative to said handle for manual operation and a second portion having a formation operatively engaging said switch operator member; and (d) means for biasing said second operator member in a position placing said switch operator member in said second position and allowing pivotal movement of said second operator member to a position placing said switch operator member in said first position:

(e) whereby in response to manual operation of said first and second operator members said switch operator member is moved to said first position for closing said switch to place said motor in operation.

14. Apparatus according to claim 13 further comprising:

(a) presser foot means movably carried by said housing located in spaced relation to said blade cutting edge and movable toward and away from a base of said housing spaced therefrom:

(b) elongated guard means operatively connected to said presser foot means and located closely adjacent said blade cutting edge and guidedly supported in said housing for movement along said blade edge into and out of guarding relation to said blade edge in response to movement of said presser foot means toward and away from said base.

15. Apparatus according to claim 14 wherein said guard means is flexible and travels along a path having a first portion closely adjacent said blade cutting edge, a second portion offset from said first portion and located in said housing and a third portion joining said first and second portions.

16. Apparatus according to claim 13 further comprising:

(a) presser foot means movably carried by said housing located in spaced relation to said blade cutting edge and normally freely movable toward and away from a base of said housing spaced therefrom;

(b) means for holding said presser foot means at selected distances from said base during operation of said machine: and (c) means operatively connected to said switch means and connected in controlling relation to said holding means for releasing said holding means when said motor is de-energized to maintain said presser foot in a position near said base when said motor is de-energized.

17. Apparatus according to claim 16, wherein said means for releasing said holding means comprises:

(a) manually operated means normally in a first position where said switch means is open and movable to a second position where said switch means is closed; and (b) mechanical means operatively connected to said manually operated means and operatively engaging said holding means in a manner such that when said manually operated means is in said first position said mechanical means causes said holding means to release said presser foot means.

18. In a cutting machine comprising a housing having a base spaced therefrom, a motor carried by said housing, switch means for controlling operation of said motor, a knife blade having a cutting edge and carried by said housing for reciprocal movement along a plane generally normal to said base in response to operation of said motor, presser foot means movably carried by said housing located in spaced relation to said blade cutting edge and normally freely movable toward and away from said base, means for holding said presser foot means at selected distances from said base during operation of said machine, and blade sharpening means movably carried by said housing normally located near the end of said blade opposite said base and movable along said blade toward and away from said base during sharpening of said blade, the improvement comprising:

(a) a single elongated and flexible guard operatively connected to said presser foot means and located closely adjacent said blade cutting edge and guidedly supported in said housing for movement along said blade edge into and out of guarding relation to said blade edge and around said sharpening means in response to movement of said presser foot means toward and away from said base;

(b) means operatively connected to said motor control switch means and connected in controlling relation to said holding means for releasing said holding means when said motor is deenergized by action of said motor control switch means to maintain said presser foot means in a position near said base when said motor is deenergized; and (c) guide means carried by said sharpening means for moving said guard away from said blade cutting edge and in a direction substantially parallel to said plane of said blade as said sharpening means moves therealong and for returning said guard closely adjacent said blade cutting edge as said sharpening means returns to its normal location.

19. Apparatus according to claim 18, wherein said guard travels along a path having a first portion closely adjacent said blade cutting edge, a second portion offset from said first portion and located in said housing and a third portion joining said first and second portions and extending around said sharpening means.

20. In a cutting machine comprising a housing having a base spaced therefrom, a motor carried by said housing, a knife blade having a cutting edge and carried by said housing for reciprocal movement generally normal to said base in response to operation of said motor, and presser foot means movably carried by said housing located in spaced relation to said blade cutting edge and movable toward and away from said base, the improvement comprising:

elongated guard means operatively connected to said presser foot means and located closely adjacent said blade cutting edge and guidedly supported in said housing for movement along said blade edge into and out of guarding relation to said blade edge in response to movement of said presser foot means toward and away from said base, said guard means being flexible and in the form of a roller chain comprising a plurality of roller pins pivotally joined by a plurality of links, the longitudinal axes of said roller pins being substantially perpendicular to the plane of said blade and said links being dispossed in planes substantially parallel to the plane of said blade and in substantially straddling relation to said blade edges.

21. In a cutting machine comprising a housing having a base spaced therefrom, a motor carried by said housing, the operation of said motor being controlling by switch means, a knife having a cutting edge and carried by said housing for reciprocal movement generally normal to said base in response to operation of said motor, presser foot means movably carried by said housing located in spaced relation to said blade cutting edge and movable normally freely toward and away from said base, and means for holding said presser foot means at selected distances from said base during operation of said machine:

(a) elongated guard means operatively connected to said presser foot means and located closely adjacent said blade cutting edge and guidedly supported in said housing for movement along said blade edge into and out of guarding relation to said blade edge in response to movement of said presser foot means toward and away from said base; and (b) means operatively connected to said switch means and connected in controlling relation to said holding means for releasing said holding means when said motor is deenergized to maintain said presser foot in a position near said base when said motor is deenergized, said means for releasing said holding means comprising manually operated means normally in a first position where said switch means is open and movable to a second position where said switch means is closed and mechanical means operatively connected to said manually operated means and operatively engaging said holding means in a manner such that when said manually operated means is in said first position said mechinical means causes said holding means to release said presser foot means.

22. In a cutting machine comprising a housing a base spaced therefrom, a motor carried by said housing, switch means for controlling operation of said motor, a knife blade having a cutting edge and carried by said housing for reciprocal movement generally normal to said base in response to operation of said motor, presser foot means movably carried by said housing located in spaced relation to said blade cutting edge and normally freely movable toward and away from said base, and means for holding said presser foot means at selected distances from said base during operation of said machine, the improvement comprising:

means operatively connected to said switch means and connected in controlling relation to said holding means for releasing said holding means when said motor is deenergized to maintain said presser foot in a position near said base when said motor is deenergized, said means for releasing said holding means comprising manually operated means normally in a first position where said switch means is open and movable to a second position where said switch means is closed and mechanical means operatively connected to said manually operated means and operatively engaging said holding means in a manner such that when said manually operated means is in said first position said mechanical means causes said holding means to release said presser foot means.

23. In a cutting machine comprising a housing having a base spaced therefrom, a motor carried by said housing, switch means for controlling operation of said motor, a knife blade having a cutting edge and carried by said housing for reciprocal movement generally normal to said base in response to operation of said motor, presser foot means movably carried by said housing located in spaced relation to said blade cutting edge and normally freely movable toward and away from said base, and means for holding said presser foot means at selected distances from said base during operation of said machine, the improvement comprising:

means operatively connected to said switch means and connected in controlling relation to said holding means for releasing said holding means when said motor is deeneergized to maintain said presser foot in a position near said base when said motor is deenergized, said means for releasing said holding means comprising:

(a) lever means having a first end opertively engaging said holding means and having a second end spaced therefrom;

(b) means for movably connecting said lever to said housing between said first and second ends;

(c) first biasing means supported by said housing and operatively contacting said holding means for causing said holding means to hold said presser foot means at a selected location;

(d) manually operated means movable between a first position where said switch means is open to a second position where said switch means is closed;

(e) second biasing means normally urging said manually operated means to said first position; and (f) means for connecting said manually operated means to said second end of said lever means in a manner such that when said manually operated means is in said first position said lever means causes said holding means to release said presser foot means.

24. In a cutting machine comprising housing having a base spaced therefrom, a motor carried by said housing, switch means for controlling operation of said motor, a knife blade having a cutting edge and carried by said housing for reciprocal movement generally normal to said base in response to operation of said motor, presser foot means movably carried by said housing located in spaced relation to said blade cutting edge and normally freely movable toward and away from said base, means for holding said presser foot means at selected distances from said base during operation of said machine, and blade sharpening means movably carried by said housing normally located near the end of said blade opposite said base and movable along said blade toward and away from said base during sharpening of said blade, the improvement comprising:

(a) elongated and flexible guard means operatively connected to said presser foot means and located closely adjacent said blade cutting edge and guidedly supported in said housing for movement along said blade edge into and out of guarding relation to said blade edge edge and around said sharpening means in response to movement of said presser foot means toward and away from said base;

(b) means operatively connected to said switch means and connected in controlling relation to said holding means for releasing said holding means when said motor is deenergized to maintain said presser foot means in a position near said base when said motor is deenergized, said means for releasing said holding means comprising manually operated means normally in a first position where said switch means is open and movable to a second position where said swithc means is closed and mechanical means operatively connected to said manually operated means and operatively engaging said holding means in a manner such that when said manually operated means is in said first position said mechanical means causes said holding means to release said presser foot means; and (c) guide carried by said sharpening means for moving said guard means away from said blade cutting edge as said sharpening means moves therealong and for returning said guard means closely adjacent said blade cutting edge as said sharpening means returns to its normal location.

25. In a cutting machine comprising a housing having a base spaced therefrom, a motor carried by said housing, a knife blade having a cutting edge and carried by said housing for reciprocal movement along a plane generally normal to said base in response to operation of said motor, and presser foot means movably carried by said housing located in spaced relation to said blade cutting edge and movable toward and away from said base, the improvement comprising:

a single elongated guard operatively connected to said presser foot means and located closely adjacent said blade cutting edge and guidedly supported in said housing for movement along said blade edge into and out of guarding relation to said blade edge in response to movement of said presser foot means toward and away from said base, said guard being flexible and travelling along a path having a first portion closely adjacent said blade cutting edge, a second portion offset from said first portion generally parallel thereto and located in said housing and a third portion joining said first and second portions, said first, second and third portions of said path being located substantially in a plane parallel to said plane of said blade.

* * * * *